US009437067B2

(12) United States Patent
Yin et al.

(10) Patent No.: US 9,437,067 B2
(45) Date of Patent: Sep. 6, 2016

(54) FINANCIAL SELF-SERVICE EQUIPMENT AND BANKNOTE SEPARATION APPARATUS AND SEPARATION METHOD THEREOF

(71) Applicant: GRG Banking Equipment Co., Ltd., Guangzhou, Guangdong (CN)

(72) Inventors: Guangjun Yin, Guangzhou (CN); En Wu, Guangzhou (CN); Zhe Li, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 18 days.

(21) Appl. No.: 14/416,624

(22) PCT Filed: Mar. 22, 2013

(86) PCT No.: PCT/CN2013/073027

§ 371 (c)(1),
(2) Date: Jan. 22, 2015

(87) PCT Pub. No.: WO2014/044034

PCT Pub. Date: Mar. 27, 2014

(65) Prior Publication Data

US 2015/0187159 A1 Jul. 2, 2015

(30) Foreign Application Priority Data

Sep. 21, 2012 (CN) ..... 2012 1 0356752

(51) Int. Cl.
*B65H 3/54* (2006.01)
*B65H 3/06* (2006.01)
*G07D 11/00* (2006.01)

(52) U.S. Cl.
CPC ..... *G07D 11/0021* (2013.01); *B65H 3/063* (2013.01); *B65H 3/54* (2013.01); *G07D 11/0081* (2013.01); *B65H 2511/152* (2013.01); *B65H 2515/34* (2013.01); *B65H 2701/1912* (2013.01)

(58) Field of Classification Search
CPC .... B65H 3/54; B65H 3/063; B65H 2515/34; B65H 2511/152
See application file for complete search history.

(56) References Cited

U.S. PATENT DOCUMENTS 3,869,116 A 3/1975 Kroeker
4,787,617 A 11/1988 Ebihara (Continued)

FOREIGN PATENT DOCUMENTS

CN 1226505 A 8/1999
CN 101580183 A 11/2009

(Continued)

OTHER PUBLICATIONS

International Search Report dated Jun. 27, 2013 from corresponding International Application PCT/CN2013/073027.

(Continued)

*Primary Examiner* — Patrick Cicchino
(74) *Attorney, Agent, or Firm* — Wolf, Greenfield & Sacks, P.C.

(57) ABSTRACT

Disclosed is a banknote separation apparatus, comprising a banknote support plate used for bearing banknotes to be separated, a reference plate used for laying and ordering banknotes, a banknote pressing plate used for supplying compression on banknotes to be separated, a banknote separating wheel formed with a high friction part and exposed at the outside of the banknote support plate and arranged facing the banknote pressing plate, a feeding wheel and a reverse wheel arranged facing the feeding wheel, wherein the banknote separating apparatus further comprises a pressure compensation apparatus used to provide a variable compression compensation force to the banknote separating wheel so as to make the total positive pressure to which the banknote separating wheel is subjected constant. That is to say, the provision of a pressure compensation apparatus makes the frictional force for separating banknotes of the banknote separation apparatus constant.

13 Claims, 4 Drawing Sheets

(56) References Cited

U.S. PATENT DOCUMENTS

| | | | | |
|---|---|---|---|---|
| 5,462,267 | A * | 10/1995 | Hori | B65H 3/0669 271/10.04 |
| 5,893,555 | A * | 4/1999 | Kawada | B65H 1/14 271/117 |
| 5,927,703 | A * | 7/1999 | Endo | B65H 3/06 271/10.03 |
| 6,338,480 | B1 * | 1/2002 | Endo | B65H 3/5223 271/104 |
| 7,648,134 | B2 * | 1/2010 | Lim | B65H 3/0607 271/117 |
| 2003/0116906 | A1 * | 6/2003 | Amamoto | B65H 1/12 271/126 |
| 2004/0013158 | A1 | 1/2004 | Bazhenov et al. | |
| 2005/0035531 | A1 * | 2/2005 | Sasaki | B65H 1/12 271/126 |
| 2008/0224391 | A1 * | 9/2008 | Oshima | B65H 1/14 271/265.01 |
| 2008/0224392 | A1 * | 9/2008 | Oshima | B65H 1/14 271/265.04 |
| 2010/0032889 | A1 * | 2/2010 | Krause | B65H 3/045 271/12 |
| 2013/0106048 | A1 | 5/2013 | Geserich | |
| 2013/0221607 | A1 * | 8/2013 | Chiba | B65H 3/0684 271/117 |
| 2013/0292896 | A1 * | 11/2013 | Yoshii | B65H 1/14 271/97 |
| 2014/0374986 | A1 * | 12/2014 | Takada | G07D 11/0018 271/162 |

FOREIGN PATENT DOCUMENTS

| | | | |
|---|---|---|---|
| CN | 202033789 | U | 11/2011 |
| CN | 202443533 | U | 9/2012 |
| CN | 102867359 | A | 1/2013 |
| DE | 202011107379.7 | U1 | 1/2011 |
| EP | 2 251 286 | A2 | 11/2010 |
| GB | 2197854 | A | 6/1988 |
| JP | H11227954 | A | 8/1999 |
| WO | WO 2011150961 | A1 | 12/2011 |

OTHER PUBLICATIONS

Extended European Search Report, dated Sep. 24, 2015, from corresponding European Application No. 13839685.8.

* cited by examiner

FINANCIAL SELF-SERVICE EQUIPMENT AND BANKNOTE SEPARATION APPARATUS AND SEPARATION METHOD THEREOF

The present application is the national phase of international application no. PCT/CN2013/073027, filed on Mar. 22, 2013, which claims the benefit of Chinese Patent Application No. 201210356752.2, entitled "FINANCIAL SELF-SERVICE EQUIPMENT AND BANKNOTE SEPARATING DEVICE AND SEPARATING METHOD OF THE SAME", filed with the Chinese State Intellectual Property Office on Sep. 21, 2012, which applications are hereby incorporated by reference to the maximum extent allowable by law.

FIELD OF THE INVENTION

The present application relates to the sheet medium separation technology, and particularly to a financial self-service equipment, a banknote separating device and a banknote separating method.

BACKGROUND OF THE INVENTION

As shown in FIG. 1, a frictional-type banknote separating device of a conventional financial self-service equipment includes a banknote supporting plate 01, a reference plate 02, a banknote pressing plate 03, and a banknote separating wheel 04 and a feeding wheel 05 which are both formed with a high frictional portion and are exposed outside the banknote supporting plate 01 and arranged opposite to the banknote pressing plate 03, and a reverse wheel 06 arranged opposite to the feeding wheel 05. When a stack of banknotes is put into a placement space 101 for banknotes to be separated, the banknote pressing plate 03 is raised up under the action of a power device (not shown), when the banknotes are to be separated, the power device no longer restricts the banknote pressing plate 03, and the banknote pressing plate 03 falls freely towards the banknote supporting plate 01 under its own weight, thereby applying a pressing force to the stack of banknotes, the gravities of the banknote pressing plate 03 and the stack of banknotes together provide a frictional force for banknotes separation. The banknote separating wheel 04 conveys the stack of banknotes towards the feeding wheel 05, and the banknotes are separated one by one and then are conveyed along a banknotes separating direction 102 under the action of the reverse wheel 06.

However, the conventional frictional-type banknotes separating mechanisms have following defects due to the limitations of its own structure, that the self-weight of the banknote pressing plate is constant, and as the quantity of the whole stack of banknotes to be separated continuously reduces during banknotes separating process, self-weight of the whole stack of banknotes is reduced continuously, such that a normal pressure provided to the banknote separating frictional wheel is also reduced continuously, however, changing of the frictional force for banknotes separating will cause the banknotes separating performance unstable.

SUMMARY OF THE INVENTION

An object of the present application is to provide a banknote separating device, a normal pressure applied on a banknote separating friction wheel thereof being maintained constant, thereby insuring the stability of the banknotes separating performance.

Another object of the present application is to provide a financial self-service equipment having the above banknote separating device.

A banknote separating device includes a banknote supporting plate for carrying banknotes to be separated; a reference plate for aligning the banknotes; a banknote pressing plate for providing a pressing force to the banknotes to be separated; a banknote separating wheel and a feeding wheel which are both formed with a high frictional portion and are exposed outside the banknote supporting plate and arranged opposite to the banknote pressing plate; and a reverse wheel arranged opposite to the feeding wheel; wherein, the banknote separating device further includes a pressure compensating device for providing a variable pressing compensating force to the banknote separating wheel, such that a total normal pressure applied on the banknote separating wheel is constant.

Specifically, the banknote separating device further includes a stress collecting device for collecting a stress value on the banknote supporting plate, and a distance collecting device for collecting a current thickness of a stack of banknotes, and the stress collecting device and the distance collecting device provide a calculation parameter for timely adjusting the pressing compensating force to the pressure compensating device.

Preferably, the pressure compensating device includes a control unit, an electromagnet fixedly mounted on the banknote supporting plate, and a magnet fixedly mounted on the banknote pressing plate and attracted to the electromagnet or the banknote pressing plate itself having a function of being attracted to the electromagnet; and the control unit is configured to output an electric current value to the electromagnet based on the stress value on the banknote supporting plate collected by the stress collecting device and the current thickness value of the stack of banknotes collected by the distance collecting device, so as to provide the variable pressing compensating force.

Specifically, the control unit includes a pressure compensation calculating unit for calculating a pressure loss value based on a stress collected by a stress sensor; an electric current output controlling unit for outputting a corresponding electric current value to the electromagnet based on information of the pressure loss value and the thickness of the banknotes, so as to control the electromagnet to output a corresponding pressing compensating force; and a storage unit for storing information of the electric current output value corresponding to the information of various pressure loss values and distances, and gravities of the banknote supporting plate and the banknote pressing plate.

Specifically, a relationship among the electric current value x, the pressure loss value $Y_3$ and the thickness H of the whole stack of banknotes to be separated is as follow: $Y_3 = k_1x + k_2H$; in which $k_1$ is a proportional constant between the electric current and a generated electromagnetic force, and $k_2$ is a proportional constant between the distance H and a magnetic attractive force.

Preferably, the stress collecting device is a stress sensor fixedly mounted at a bottom of the banknote supporting plate.

Preferably, the distance collecting device is a distance sensor mounted on a surface of the banknote supporting plate outside a banknotes stacking zone.

The present application further provides a financial self-service equipment including a banknote separating device, an identification module, a temporary storage module, a banknote withdrawal module and a cashbox, wherein the banknote separating device includes a banknote supporting plate for carrying banknotes to be separated; a reference plate for aligning the banknotes; a banknote pressing plate for providing a pressing force to the banknotes to be separated; a banknote separating wheel and a feeding wheel which are both formed with a high frictional portion and are exposed outside the banknote supporting plate and arranged opposite to the banknote pressing plate; and a reverse wheel arranged opposite to the feeding wheel; wherein, the banknote separating device further includes a pressure compensating device for providing a variable pressing compensating force to the banknote separating wheel, such that a total normal pressure applied on the banknote separating wheel is constant.

Specifically, the banknote separating device further includes a stress collecting device for collecting a stress value on the banknote supporting plate, and a distance collecting device for collecting a current thickness of a stack of banknotes, and the stress collecting device and the distance collecting device provide a calculation parameter for timely adjusting the pressing compensating force to the pressure compensating device.

Preferably, the pressure compensating device includes a control unit, an electromagnet fixedly mounted on the banknote supporting plate, and a magnet fixedly mounted on the banknote pressing plate and attracted to the electromagnet or the banknote pressing plate itself having a function of being attracted to the electromagnet; and the control unit is configured to output an electric current value to the electromagnet based on the stress value on the banknote supporting plate collected by the stress collecting device and the current thickness value of the stack of banknotes collected by the distance collecting device, so as to provide the variable pressing compensating force.

Specifically, the control unit includes a pressure compensation calculating unit for calculating a pressure loss value based on a stress collected by a stress sensor; an electric current output controlling unit for outputting a corresponding electric current value to the electromagnet based on information of the pressure loss value and the thickness of the banknotes, so as to control the electromagnet to output a corresponding pressing compensating force; and a storage unit for storing information of the electric current output value corresponding to the information of various pressure loss values and distances, and gravities of the banknote supporting plate and the banknote pressing plate.

Specifically, a relationship among the electric current value x, the pressure loss value $Y_3$ and the thickness H of the whole stack of banknotes to be separated is as follow: $Y_3=k_1x+k_2H$; in which $k_1$ is a proportional constant between the electric current and a generated electromagnetic force, and $k_2$ is a proportional constant between the distance H and a magnetic attractive force.

Preferably, the stress collecting device is a stress sensor fixedly mounted at a bottom of the banknote supporting plate.

Preferably, the distance collecting device is a distance sensor mounted on a surface of the banknote supporting plate outside a banknotes stacking zone.

The present application further provides a method for separating banknotes including the following steps:

step 1: obtaining a preset normal pressure value $Y_1$ generating a frictional force for separating banknotes according to a design principle of frictional-type banknotes separation for a banknote separating device, and storing the preset normal pressure value $Y_1$, a gravity $Y_t$ of a banknote supporting plate and a gravity $Y_2$ of a banknote pressing plate into a storage unit;

step 2: detecting a current thickness $H_0$ of a stack of banknotes and a stress value $Y_y$ on the banknote supporting plate, and calculating a gravity $Y_0$ of the stack of banknotes based on an equation of $Y_0=Y_y-Y_t-Y_2$;

step 3: calculating a pressure loss value $Y_3$ according to an equation of $Y_3=Y_1-Y_0-Y_2$;

step 4: calculating an electric current value required for an electromagnet in a pressure compensating device based on the current thickness $H_0$ of the stack of banknotes and the pressure loss value $Y_3$, and controlling the electromagnet to output a corresponding pressing compensating force; and step 5: repeating steps 2 to 4 in cycles, and maintaining a normal pressure value generating the frictional force for separating banknotes during banknotes separating process at an optimum level around the preset normal pressure value.

Due to the provided pressure compensating device, the frictional force for separating banknotes of the banknote separating device is constant, therefore the banknotes separating performance is stable.

DETAILED DESCRIPTION OF THE INVENTION

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the protection scope of the present application.

Figure 1:
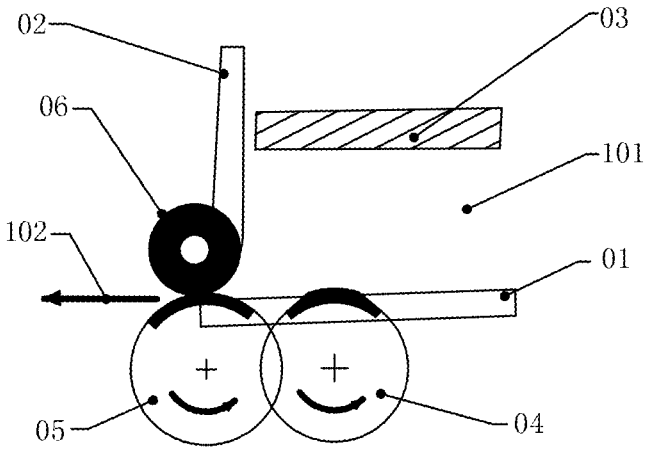
FIG. 1 is a schematic view of a conventional banknote separating device.
Figure 2:
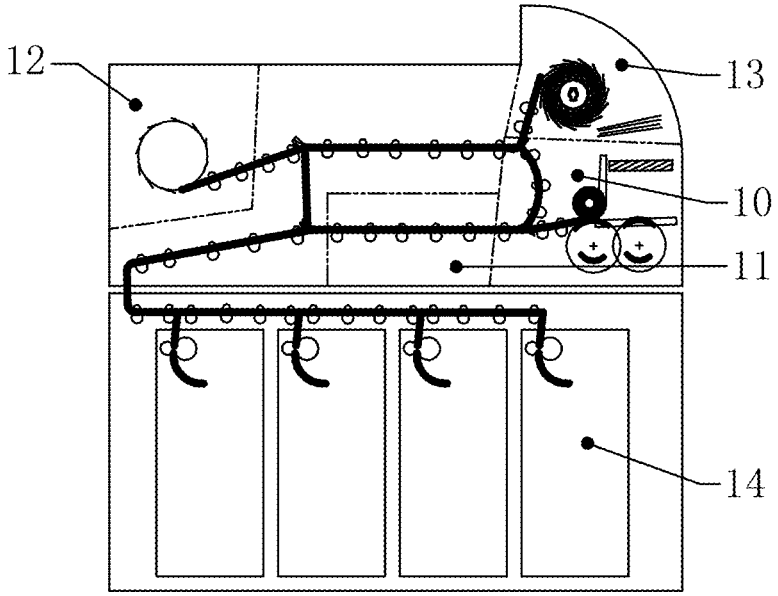
FIG. 2 is a schematic view showing a banknote separating device according to a preferred embodiment of the present application being used in a financial self-service equipment.

As shown in FIG. 2, a financial self-service equipment includes a banknote separating device 10, an identification module 11, a temporary storage module 12, a banknote withdrawal module 13 and a cashbox 14. The banknote separating device 10 is used for receiving a stack of banknotes, separating the banknotes and then conveying them to the identification module 11 along a banknote conveying passage. The banknotes identified as qualified are conveyed to the temporary storage module 12 along the banknote conveying passage, and unqualified banknotes are conveyed to the banknote withdrawal module 13 to be returned to a client; and when the client confirms the depositing operation, the banknotes are conveyed from the temporary storage module 12 to the cashbox 14 along the banknote conveying passage.

Figure 3:
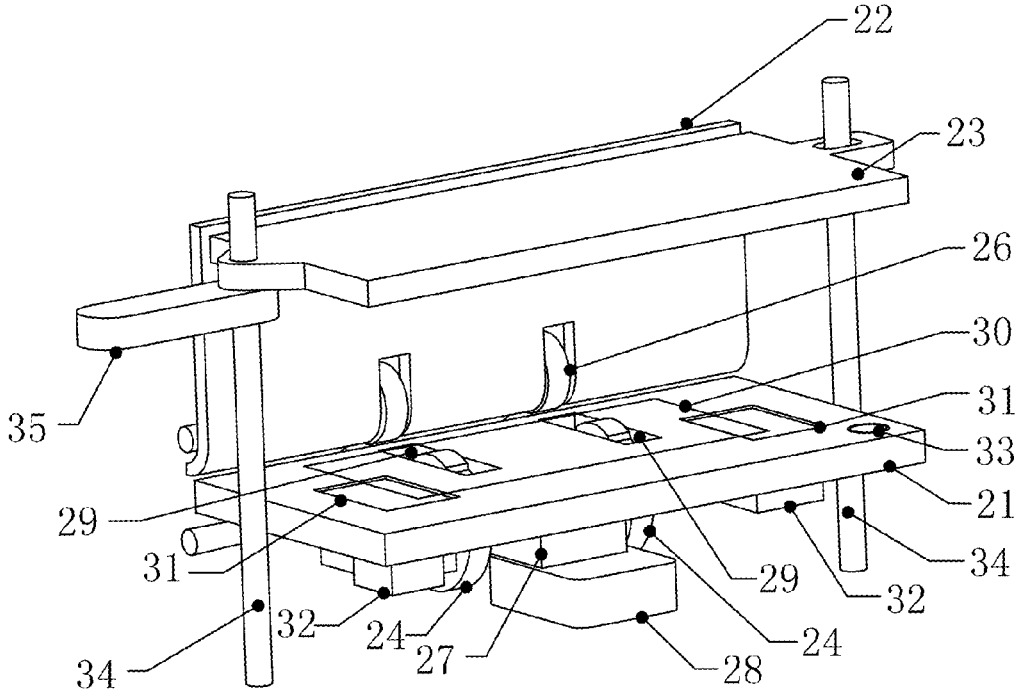
FIG. 3 is a perspective schematic view of the banknote separating device according to the preferred embodiment of the present application.
Figure 4:
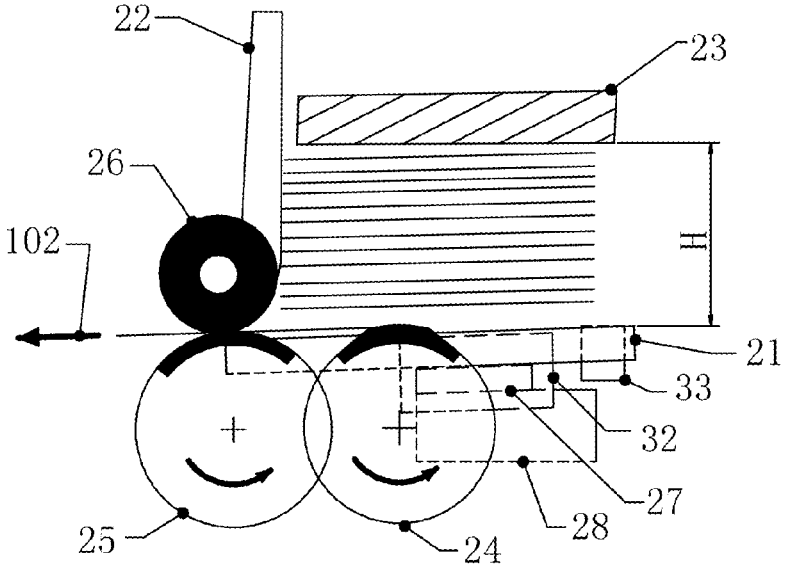
FIG. 4 is a side schematic view showing the structure of the banknote separating device in FIG. 3.

As shown in FIG. 3 and FIG. 4, the banknote separating device 10 according to the present embodiment includes a banknote supporting plate 21 for carrying the banknotes to be separated, a reference plate 22 for aligning the banknotes, a banknote pressing plate 23 for providing a pressing force to the banknotes to be separated, a banknote separating wheel 24 and a feeding wheel 25 which are both formed with a high frictional portion and are exposed outside the banknote supporting plate 21 and are arranged opposite to the banknote pressing plate 23, a reverse wheel 26 arranged opposite to the feeding wheel 25, a stress collecting device for collecting a current stress value on the banknote supporting plate 21, a pressure compensating device for providing a variable pressing compensating force, and a distance collecting device 33 for collecting a current thickness of the stack of banknotes.

A stress sensor 27 is fixedly mounted at a bottom of the banknote supporting plate 21, the other end of the stress sensor 27 is fixedly mounted on a fixed base 28, and the fixed base 28 is fixed on a frame (not shown). The banknote separating wheel 24, the feeding wheel 25, and the reverse wheel 26 are fixed onto a side wall (not shown) of the financial self-service equipment through rotation shafts respectively. The reference plate 22 is fixed perpendicularly to the banknote supporting plate 21, and the banknote pressing plate 23 and the banknote supporting plate 21 are arranged parallel with each other. Two position-limiting shafts 34 are respectively fixed at two sides of the banknote pressing plate 23, and the position-limiting shafts 34 are perpendicular to the plane of the banknote pressing plate 23. Two sides of the banknote pressing plate 23 extend outwardly to form two protruding portions respectively, a through hole is arranged in each protruding portion at the center, and the banknote pressing plate 23 is disposed on the position-limiting shafts 34 through the through holes. A switching block 35 is further disposed on the position-limiting shaft 34 and is driven by a power device (not shown), and when it is needed to store the stack of banknotes on the banknote supporting plate 21, the banknote pressing plate 23 is raised by the switching block 35 driven by the power device, and when it starts to separate the banknotes, the banknote pressing plate 23 is released by the switching block 35 driven by the power device, and the banknote pressing plate 23 falls freely under its own weight.

There is a banknotes stacking zone 30 on the banknote supporting plate 21, a first group of notches 29 are arranged within the banknotes stacking zone 30, and the banknote separating wheel 24 is exposed outside the banknote supporting plate 21 through the first group of notches 29. There are two banknote separating wheels 24 arranged side by side in the present application, and correspondingly there are two notches in the first group of notches 29.

A pressure compensating device is provided between the banknote pressing plate 23 and the banknote supporting plate 21, and in the present embodiment, an electromagnet 32 and a banknote pressing plate (23) having a function of attracting are preferably employed to cooperate with each other to act as the pressure compensating device, so as to provide the pressure compensation. The electromagnet 32 is fixedly mounted in a second group of notches 31 of the banknote supporting plate 21, and an outer surface of the electromagnet 32 is located on the same horizontal plane with an upper surface of the banknote supporting plate 21, that is, the electromagnet 32 is exposed outside the upper surface of the banknote supporting plate 21, but is not protruded outside the upper surface of the banknote supporting plate 21. In the present application, there are two groups of the second group of notches 31 and the electromagnet 32 respectively. The banknote pressing plate 23 is made of iron material. In order to increase a compensation range of the pressure compensating device, a magnet may be mounted on the banknote pressing plate 23 at a position corresponding to the electromagnet 32, and opposite magnetic poles of the magnet and the electromagnet 32 face to each other.

A distance collecting device 33 is mounted on the banknote supporting plate 21 outside the banknotes stacking zone 30, and is used for collecting a distance between the banknote pressing plate 23 and the banknote supporting plate 21. The distance collecting device 33 can employ a common distance sensor.

Figure 5:
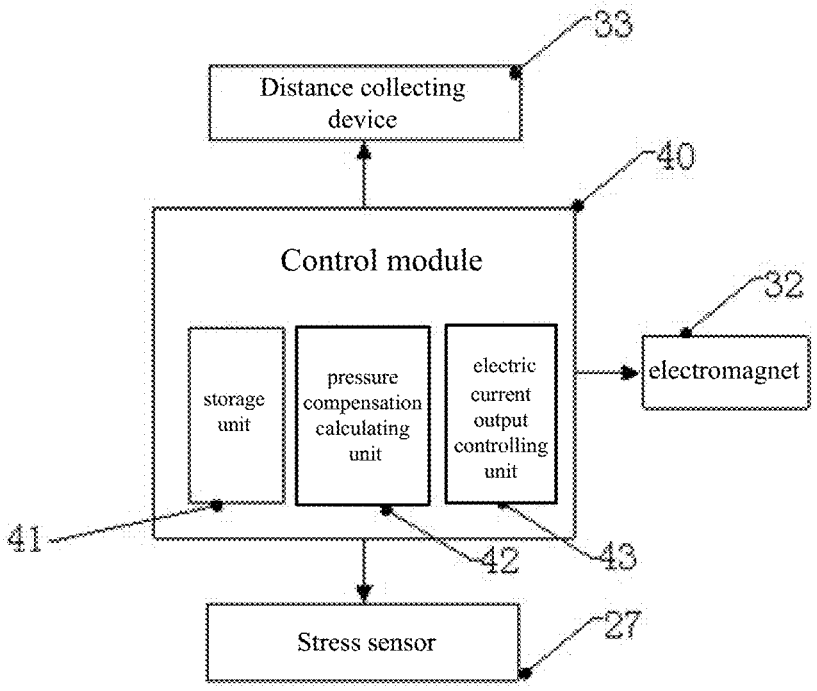
FIG. 5 is a structural view of a control system of the banknote separating device according to the preferred embodiment of the present application.

As shown in FIG. 5, the banknote separating device 10 according to the present embodiment includes a control module 40, the control module 40 is electrically connected with the distance collecting device 33, the stress sensor 27, and the electromagnet 32 respectively. The control module 40 further includes a storage unit 41 for storing the information of an output electric current value corresponding to various pressure loss values and distance information, and storing the gravities of the banknote supporting plate 21 and the banknote pressing plate 23; a pressure compensation calculating unit 42 for calculating a pressure loss value based on a stress collected by a stress sensor 27; and an electric current output controlling unit 43 for controlling the electromagnet 32 to output a corresponding pressing compensating force based on the pressure loss value and the thickness information of the banknotes. The changing of the pressing compensating force of the electromagnet 32 is achieved by controlling the output of the electric current. Specifically, a relationship among the electric current value x, the pressure loss value $Y_3$ and the thickness H of the whole stack of the banknotes to be separated is as follow: $Y_3 = k_1x + k_2H$, in which $k_1$ is a proportional constant between the electric current and the generated electromagnetic force, and $k_2$ is a proportional constant between the distance H and the magnetic attractive force.

After an operator fills the banknote supporting plate 21 with banknotes, the power device (not shown) drives the switching block 35 to release the banknote pressing plate 23, and the banknote pressing plate 23 falls freely along the position-limiting shafts 34 under its own weight, thereby pressing against the stack of banknotes.

According to a design principle of frictional-type banknotes separation, a preset normal pressure value $Y_1$ generating a frictional force for separating banknotes can be obtained previously, which is shown by the straight line C, and this value is stored in the pressure compensation calculating unit 42.

When the operation of banknotes separation is started, the distance collecting device 33 collects a current thickness $H_0$ of the stack of the banknotes, the stress sensor 27 collects a current stress value $Y_y$, and the pressure compensation calculating unit 42 obtains the pressing force applied on the banknote supporting plate 21 based on the stress value $Y_y$ minus a gravity $Y_t$ of the banknote supporting plate 21. The pressing force applied on the banknote supporting plate 21 is provided by a gravity $Y_2$ of the banknote pressing plate 23 and a gravity $Y_0$ of the stack of the banknotes, that is, $Y_y - Y_t = Y_2 + Y_0$, therefore the gravity value $Y_0$ of the stack of the banknotes can be calculated according to the equation: $Y_0=Y_y-Y_t-Y_2$, and at this time the pressure loss value $Y_3=Y_1-Y_0-Y_2$.

The electric current output controlling unit 43 calculates the electric current output value for the electromagnet 32 based on the current thickness value $H_0$ of the stack of the banknotes and the pressure loss value $Y_3$, so as to cause the pressure compensating device consisted of the electromagnet 32 and the banknote pressing plate 23 to generate a corresponding pressing compensating force, such that the pressing compensating force is equal to the current pressure loss value.

Figure 6:
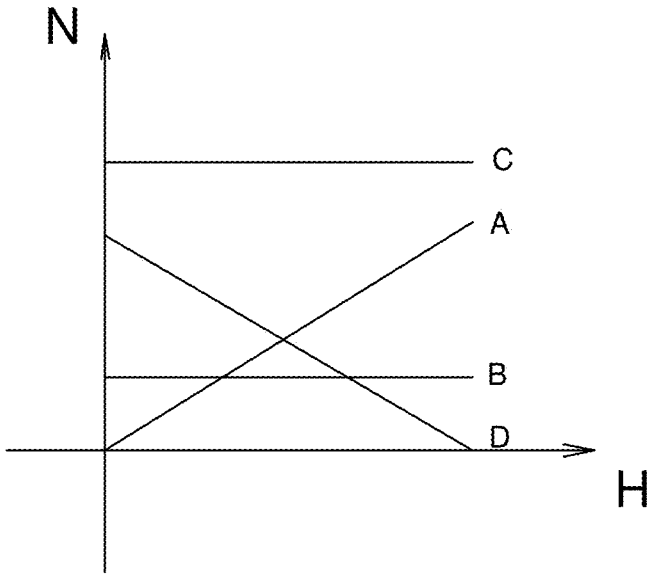
FIG. 6 is a schematic view showing the variation of a pressing force in a method for separating banknotes according to the preferred embodiment of the present application.

As shown in FIG. 6, the horizontal coordinate represents a thickness value H of the banknotes, and the vertical coordinate represents a pressure value N. The straight line B is a schematic diagram of the pressure $Y_2$ generated by the self-weight of the banknote pressing plate 23, and $Y_2$ is a constant value; the straight line C is a schematic diagram of an optimum pressing force $Y_1$, and $Y_1$ is also a constant value. As the separation of the banknotes is performed continuously, the distance sensor obtains the continuously varied thickness value H of the banknotes, and the stress sensor 27 obtains the continuously varied stress value, as shown by the straight line A, and the pressure generated by the self-weight of the stack of banknotes is directly proportional to the thickness variation; and the pressure compensation calculating unit 42 obtains the variable pressure loss value $Y_3$ based on the stress value, as shown by the straight line D, and the pressure loss value is inversely proportional to the thickness of the stack of banknotes.

The electric current output controlling unit 43 continually adjusts the electric current output value based on the variable thickness H of the banknotes and the pressure loss value $Y_3$, so as to control the current pressure compensation value generated by the electromagnet 32 to be equal to the pressure loss value, until the last piece of banknote is separated.

Figure 7:
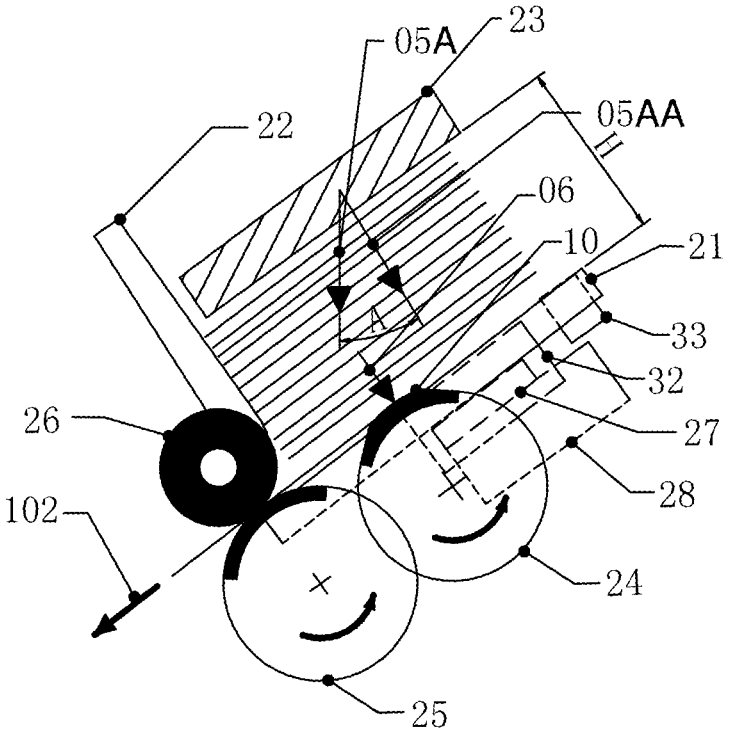
FIG. 7 is a schematic view of working principle of the banknote separating device according to the preferred embodiment of the present application being inclinedly disposed.

In the situation described hereinabove, the banknote separating device is placed horizontally, and when the banknote separating device is inclinedly disposed as shown in FIG. 7, the principle thereof is same as that in FIG. 4, and the difference lies in that the stack of banknotes is inclined and has an inclination angle A relative to the horizontal direction. A gravity 05A of the banknote pressing plate 23 has a component 05AA in the vector direction of the normal pressure 06. When calculating the normal pressure 06, the gravity 05A is replaced by the component 05AA, and the method for calculating the normal pressure generated by the stack of banknotes on the banknote supporting plate 21 is same as that of the banknote pressing plate 23, which will not be described in detail.

A method for separating banknotes according to the present embodiment includes the following steps.

Step 1: obtaining a preset normal pressure value $Y_1$ generating a frictional force for separating banknotes according to a design principle of frictional-type banknotes separation for a banknote separating device, and storing the preset normal pressure value $Y_1$, a gravity $Y_t$ of a banknote supporting plate and a gravity $Y_2$ of a banknote pressing plate into a storage unit;

Step 2: detecting a current thickness $H_0$ of a stack of banknotes and a stress value $Y_y$ on the banknote supporting plate, and calculating a gravity $Y_0$ of the stack of banknotes based on an equation of $Y_0=Y_y-Y_t-Y_2$;

Step 3: calculating a pressure loss value $Y_3$ according to an equation of $Y_3=Y_1-Y_0-Y_2$;

Step 4: calculating an electric current value required for an electromagnet in the pressure compensating device based on the current thickness $H_0$ of the stack of banknotes and the pressure loss value $Y_3$, and controlling the electromagnet to output a corresponding pressing compensating force; and Step 5: repeating steps 2 to 4 in cycles, and maintaining the normal pressure value generating the frictional force for separating banknotes during banknotes separating process at an optimum level around the preset normal pressure value.

Because of the arrangement of the pressure compensating device, the frictional force for separating banknotes is constant, therefore a banknotes separating performance of the banknote separating device is more stable.

Furthermore, the pressure compensating device can employ a magnet instead of the electromagnet, in the manner using the magnet, the pressure loss value is only relevant to the thickness of the whole stack of banknotes to be separated, the relationship thereof is as follow: $Y_3=k_2H$, in which H is the thickness of the whole stack of banknotes to be separated, and $k_2$ is a proportional constant between the distance H and the magnetic attractive force.

The above-described embodiments are only preferred embodiments of the present application. It should be noted that, for the person skilled in the art, many modifications and improvements may be made to the present application without departing from the principle of the present application, and these modifications and improvements are also deemed to fall into the protection scope of the present application.

The invention claimed is:

1. A banknote separating device, comprising:

a banknote supporting plate for carrying banknotes to be separated;

a reference plate for aligning the banknotes;

a banknote pressing plate for providing a pressing force to the banknotes to be separated;

a banknote separating wheel and a feeding wheel which are both formed with a high frictional portion and are exposed outside the banknote supporting plate and arranged opposite to the banknote pressing plate; and a reverse wheel arranged opposite to the feeding wheel;

wherein, the banknote separating device further comprises a pressure compensating device for providing a variable pressing compensating force to the banknote separating wheel, such that a total normal pressure applied on the banknote separating wheel is constant; and wherein the banknote separating device further comprises a stress collecting device for collecting a stress value on the banknote supporting plate, and a distance collecting device for collecting a current thickness of a stack of banknotes, and the stress collecting device and the distance collecting device provide a calculation parameter for timely adjusting the pressing compensating force to the pressure compensating device.

2. The banknote separating device according to claim 1, wherein the pressure compensating device comprises a control unit, an electromagnet fixedly mounted on the banknote supporting plate, and a magnet fixedly mounted on the banknote pressing plate and attracted to the electromagnet or the banknote pressing plate itself having a function of being attracted to the electromagnet; and the control unit is configured to output an electric current value to the electromagnet based on the stress value on the banknote supporting plate collected by the stress collecting device and the current thickness value of the stack of banknotes collected by the distance collecting device, so as to provide the variable pressing compensating force.

3. The banknote separating device according to claim 2, wherein the control unit comprises:

a pressure compensation calculating unit for calculating a pressure loss value based on a stress collected by a stress sensor;

an electric current output controlling unit for outputting a corresponding electric current value to the electromagnet based on information of the pressure loss value and the thickness of the banknotes, so as to control the electromagnet to output a corresponding pressing compensating force; and a storage unit for storing information of the electric current output value corresponding to the information of various pressure loss values and distances, and gravities of the banknote supporting plate and the banknote pressing plate.

4. The banknote separating device according to claim 3, wherein a relationship among the electric current value, the pressure loss value and the thickness of the banknotes is as follow: $Y_3 = k_1x + k_2H$; in which $Y_3$ is the pressure loss value, x is the electric current value, $k_1$ is a proportional constant between the electric current and a generated electromagnetic force, H is the thickness of the stack of banknotes to be separated, and $k_2$ is a proportional constant between the thickness and a magnetic attractive force.

5. The banknote separating device according to claim 2, wherein the stress collecting device is a stress sensor fixedly mounted at a bottom of the banknote supporting plate.

6. The banknote separating device according to claim 2, wherein the distance collecting device is a distance sensor mounted on a surface of the banknote supporting plate outside a banknotes stacking zone.

7. A financial self-service equipment, comprising a banknote separating device, an identification module, a temporary storage module, a banknote withdrawal module and a cashbox, wherein the banknote separating device is the banknote separating device according to claim 1.

8. A method for separating banknotes, comprising the following steps:

step 1: obtaining a preset normal pressure value $Y_1$ generating a frictional force for separating banknotes according to a design principle of frictional-type banknotes separation for a banknote separating device, and storing the preset normal pressure value $Y_1$, a gravity $Y_t$ of a banknote supporting plate and a gravity $Y_2$ of a banknote pressing plate into a storage unit;

step 2: detecting a current thickness $H_0$ of a stack of banknotes and a stress value $Y_y$ on the banknote supporting plate, and calculating a gravity $Y_0$ of the stack of banknotes based on an equation of $Y_0 = Y_y - Y_t - Y_2$;

step 3: calculating a pressure loss value $Y_3$ according to an equation of $Y_3 = Y_1 - Y_0 - Y_2$;

step 4: calculating an electric current value required for an electromagnet in a pressure compensating device based on the current thickness $H_0$ of the stack of banknotes and the pressure loss value $Y_3$, and controlling the electromagnet to output a corresponding pressing compensating force; and step 5: repeating steps 2 to 4 in cycles, and maintaining a normal pressure value generating the frictional force for separating banknotes during banknotes separating process at an optimum level around the preset normal pressure value.

9. A financial self-service equipment, comprising a banknote separating device, an identification module, a temporary storage module, a banknote withdrawal module and a cashbox, wherein the banknote separating device is the banknote separating device according to claim 2.

10. A financial self-service equipment, comprising a banknote separating device, an identification module, a temporary storage module, a banknote withdrawal module and a cashbox, wherein the banknote separating device is the banknote separating device according to claim 3.

11. A financial self-service equipment, comprising a banknote separating device, an identification module, a temporary storage module, a banknote withdrawal module and a cashbox, wherein the banknote separating device is the banknote separating device according to claim 4.

12. A financial self-service equipment, comprising a banknote separating device, an identification module, a temporary storage module, a banknote withdrawal module and a cashbox, wherein the banknote separating device is the banknote separating device according to claim 5.

13. A financial self-service equipment, comprising a banknote separating device, an identification module, a temporary storage module, a banknote withdrawal module and a cashbox, wherein the banknote separating device is the banknote separating device according to claim 6.

* * * * *